US007234656B1

(12) United States Patent
Lo

(10) Patent No.: US 7,234,656 B1
(45) Date of Patent: Jun. 26, 2007

(54) PAPER SHREDDER PAPER FEED MECHANISM

(76) Inventor: Emily Lo, No. 18, Lane 20, Hsin Feng Street, Hsin Chuang City, Taipei Shien (TW)

( * ) Notice: Subject to any disclaimer, the term of this patent is extended or adjusted under 35 U.S.C. 154(b) by 99 days.

(21) Appl. No.: 11/123,718

(22) Filed: May 9, 2005

(51) Int. Cl.
*B02C 18/16* (2006.01)

(52) U.S. Cl. ..... 241/34; 241/236

(58) Field of Classification Search ..... 241/34, 241/236

See application file for complete search history.

(56) References Cited

U.S. PATENT DOCUMENTS 4,944,461 A * 7/1990 Farnsworth ..... 241/36
2004/0140382 A1* 7/2004 Ho ..... 241/236
2005/0127216 A1* 6/2005 Mead et al. ..... 240/30

* cited by examiner

*Primary Examiner*—Lowell A. Larson
*Assistant Examiner*—Jason Y. Pahng
(74) *Attorney, Agent, or Firm*—Pro-Techtor Int'l Services

(57) ABSTRACT

A paper shredder paper feed mechanism, characterized in having a paper insert opening structured from two movable paper feed tubes, which are configured above paper shredding cutters. Two ends of each of the paper feed tubes are respectively positioned in W-shaped embed grooves of positioning plates of a frame. The two paper feed tubes are ordinarily closed together, thereby enhancing safety and preventing dust and miscellaneous objects from falling into the paper shredder. When paper is inserted into the paper insert opening, the thickness of the paper opens the two paper feed tubes, thereby guiding the paper smoothly guided into the paper shredding cutters.

2 Claims, 3 Drawing Sheets

PAPER SHREDDER PAPER FEED MECHANISM

BACKGROUND OF THE INVENTION (a) Field of the Invention

The present invention relates to a paper shredder, and more particularly to a paper insert opening structured from two movable paper feed tubes, which expand to adapt to the thickness of paper fed therebetween, and close when not in use, thereby enhancing safety and preventing dust and miscellaneous objects from falling into the paper shredder. Furthermore, the two paper feed tubes guide paper smoothly into the paper shredder, thereby preventing the paper from entering paper shredding cutters at an angle and becoming crimpled.

(b) Description of the Prior Art

Referring to FIG. 1, which shows a conventional paper shredder 100, a top end of which is provided with a paper insert opening 101 for inserting paper therein. Paper shredding cutters 102 within the paper shredder 100 shred the paper. Because an opening of the paper insert opening 101 is fixed, thus, when paper is inserted into the paper insert opening 101, the paper often slants to one side, thereby causing the paper to become crimpled. The paper shredding cutters 102 can ordinarily be seen through the open paper insert opening 101, which is not only unsightly, but also enables dust or miscellaneous objects to fall into the paper shredding cutters 102, thereby affecting serviceable life of the paper shredder 100, and endangering small fingers of a child that are at risk of being severed by the paper shredding cutters 102.

SUMMARY OF THE INVENTION

A primary objective of the present invention is to provide a paper shredder with a paper insert opening structured from two movable paper feed tubes, which expand to adapt to the thickness of paper fed therebetween, and close when not in use, thereby enhancing safety and preventing dust and miscellaneous objects from falling into the paper shredder. Furthermore, the two paper feed tubes guide paper smoothly into the paper shredder, thereby preventing the paper from entering paper shredding cutters at an angle and becoming crimpled.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
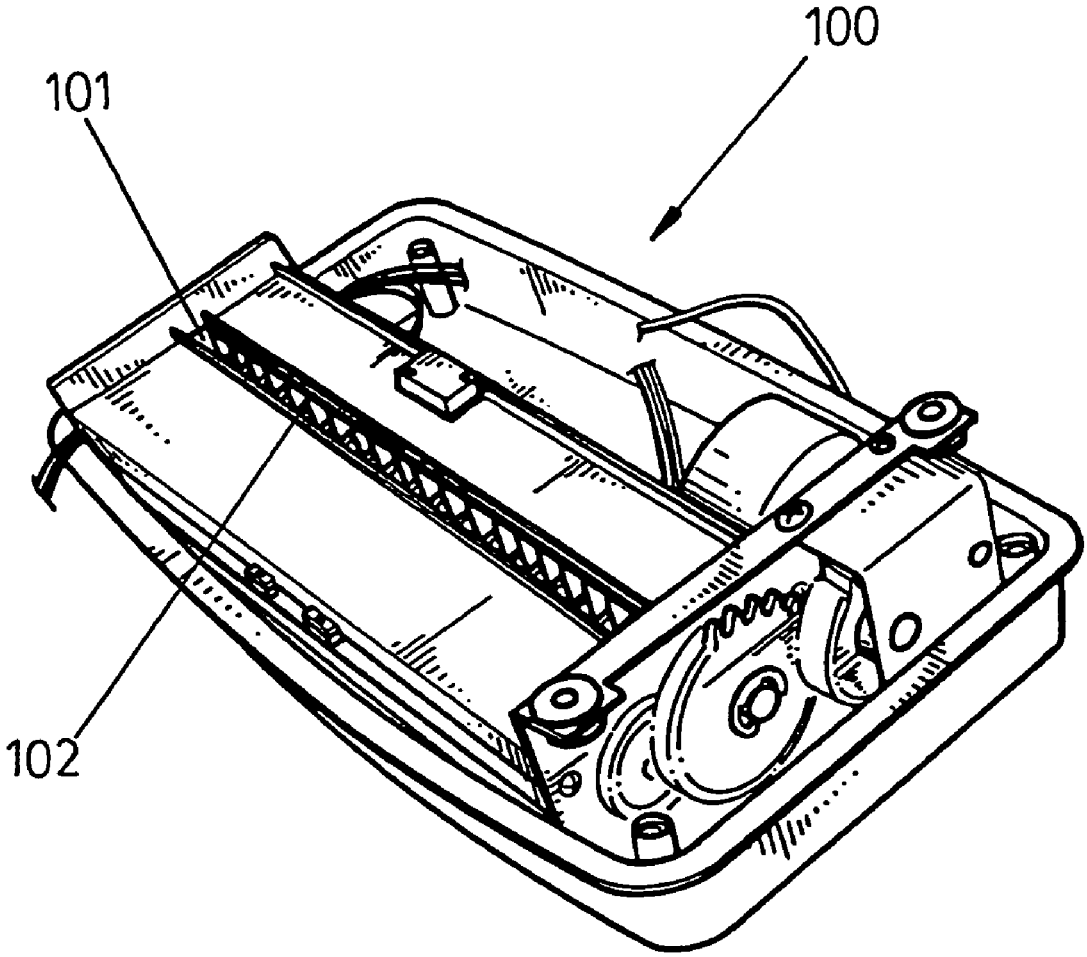
FIG.1 (PRIOR ART)
FIG. 1 shows an external view of a conventional product.
Figure 2:
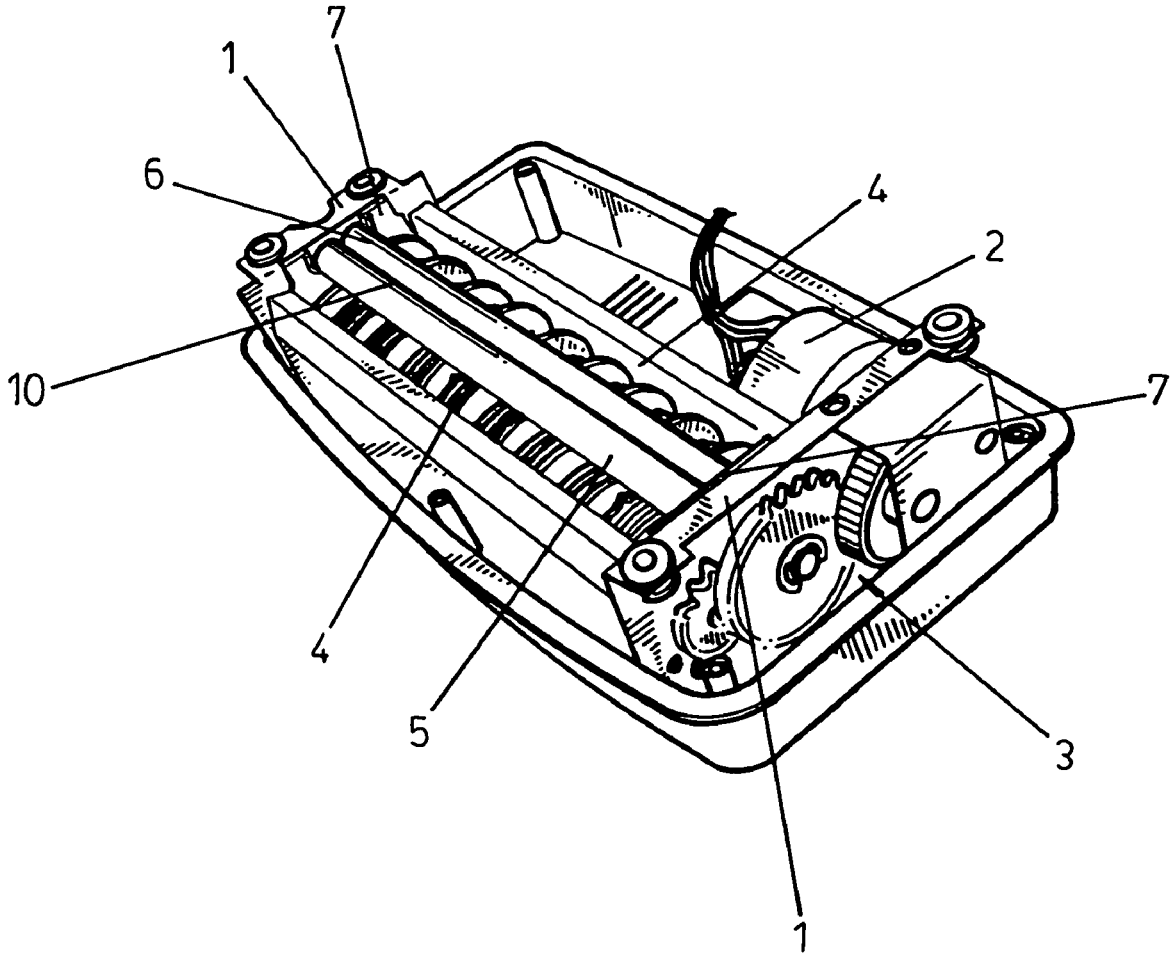
FIG. 2 shows an external view according to the present invention.
Figure 3:
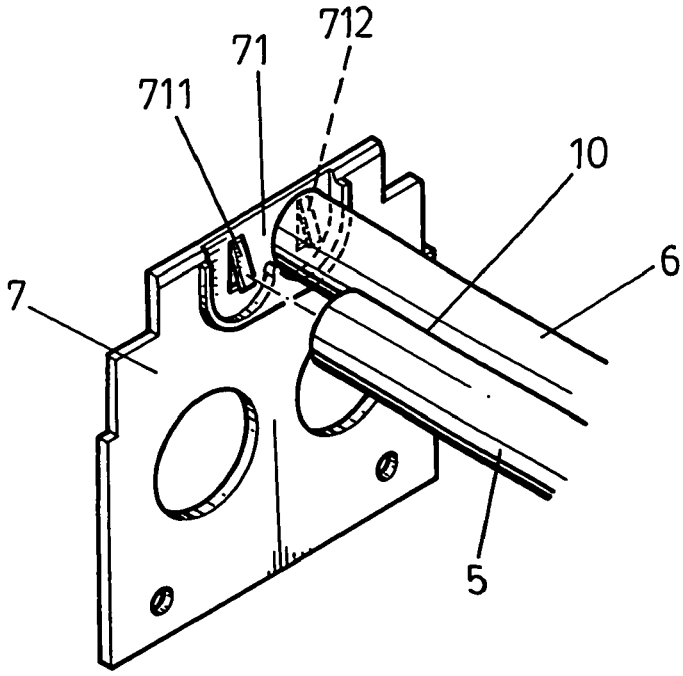
FIG. 3 shows a partial structural view according to the present invention.
Figure 4:
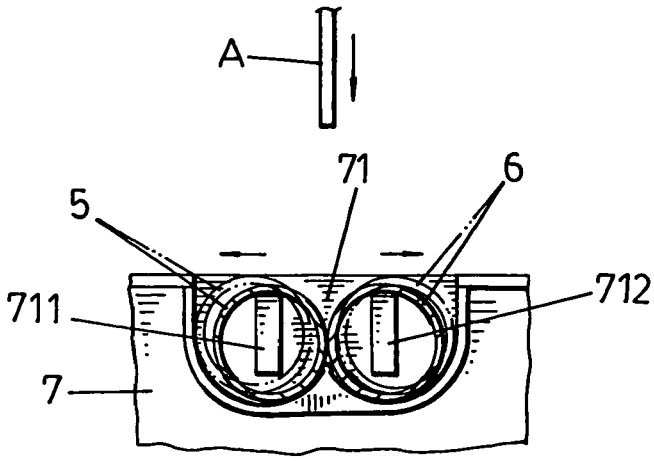
FIG. 4 shows an end schematic view of two paper feed tubes according to the present invention.

Referring to FIGS. 2, 3 and 4, which show a paper shredder of the present invention structured to comprise frames 1, a motor 2, a decelerator 3 and paper shredding cutters 4. The paper shredder is characterized in that a paper insert opening 10 configured above the paper shredding cutters 4 is structured from two paper feed tubes 5, 6. Two ends of each of the paper feed tubes 5, 6 respectively embed into positioning plates 7, which are respectively bolted to frames 1. A W-shaped support recess 71 formed by the intersection of two partially overlapping U-shaped recesses, each said U-shaped recess having an open top connected by straight sides to an arcuate bottom surface for supporting one end of one of said paper feed tubes, is defined on a surface of each of the positioning plates 7, and two ends of each of the W-shaped support recesses 71 are respectively provided with slide retainers 711, 712. The two paper feed tubes 5, 6 slide into the embed recesses 71 over the slide retainers 711, 712 respectively; which are thus disposed within the paper feed tubes 5, 6 (see FIG. 4). The two paper feed tubes 5, 6 are ordinarily closed together, thereby preventing dust or miscellaneous objects from falling into the paper shredder. When paper A is inserted into the paper insert opening 10 between the paper feed tubes 5, 6, the thickness of the paper A opens the two paper feed tubes 5, which respectively displace outward toward vacant spaces in the support recess 71, thereby enabling the paper A to be guided smoothly into the paper shredding cutters 4.

In conclusion, the present invention provides the paper insert opening 10 structured from the two movable paper feed tubes 5, 6, which are ordinarily closed together. When paper A is inserted into the paper insert opening 10, the thickness of the paper A pushes apart the two paper feed tubes 5, thereby enabling the paper A to be guided smoothly into the paper shredding cutters 4.

In conclusion, the present invention provides the paper insert opening 10 structured from the two movable paper feed tubes 5, 6, which are ordinarily closed together. When paper A is inserted into the paper insert opening 10, the thickness of the paper A pushes open the two paper feed tubes 5, thereby enabling the paper A to be guided smoothly into the paper shredding cutters 4.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A paper feed mechanism for a paper shredder including a frame, a motor, a decelerator and paper shredding cutters, the paper feed mechanism comprising:

a pair of cylindrical paper feed tubes, each having a length and an outer diameter; supported by a pair of positioning plates adapted for mounting on two end frames of a paper shredder with each of said positioning plates positioned above a centerline of a pair of paper shredding cutters of said paper shredder, each of said positioning plates having a W-shaped support recess, in a surface facing the paper shredding cutters, formed by the intersection of two partially overlapping U-shaped recesses, each said U-shaped recess having an open top connected by straight sides to an arcuate bottom surface for supporting one end of one of said paper feed tubes, a pair of slide retainers, each located at a center of curvature of said arcuate bottom surface of said U-shaped recess and disposed interior of said paper feed tubes when said paper feed tubes are assembled into said support recesses;

whereby a paper insert opening, configured above the paper shredding cutters, is structured from said pair of paper feed tubes, which are ordinarily held closed together by the arcuate shape of the support recesses, and when paper is inserted between the paper feed tubes, the paper feed tubes displace outwardly opening the paper insert opening, thereby enabling the paper to be guided smoothly into the paper shredding cutters.

2. A paper feed mechanism for a paper shredder including a frame, a motor, a decelerator and paper shredding cutters, as described in claim 1, wherein a width of the W-shaped support recess is greater than the combined outer diameters of said pair of paper feed tubes such that the two paper feed tubes may separate laterally in said embed recess, thereby opening the paper insert opening.

* * * * *